US006254257B1

(12) United States Patent
Sieczkowski

(10) Patent No.: US 6,254,257 B1
(45) Date of Patent: Jul. 3, 2001

(54) RECESSED LIGHT FIXTURE AND REFLECTOR

(75) Inventor: Philip Sieczkowski, Moore, SC (US)

(73) Assignee: Progress Lighting, Spartanburg, SC (US)

( * ) Notice: Subject to any disclaimer, the term of this patent is extended or adjusted under 35 U.S.C. 154(b) by 0 days.

(21) Appl. No.: 09/192,614

(22) Filed: Nov. 16, 1998

(51) Int. Cl.[7] ..... F21V 17/00

(52) U.S. Cl. ..... 362/365; 362/215; 362/217; 362/297; 362/341; 362/364; 362/516

(58) Field of Search ..... 362/365, 217, 362/220, 215, 341, 348, 260, 560, 516, 370, 364, 221, 147, 148, 297, 304, 346

(56) References Cited

U.S. PATENT DOCUMENTS

| | | | | |
|---|---|---|---|---|
| 2,143,673 | | 1/1939 | Baumgartner . | |
| 2,201,094 | | 5/1940 | Kassel . | |
| 2,456,903 | * | 12/1948 | Versen | 240/78 |
| 2,892,076 | | 6/1959 | Moos . | |
| 4,287,554 | * | 9/1981 | Wolff | 362/218 |
| 4,314,223 | * | 2/1982 | Kristofek | 337/113 |
| 4,336,575 | | 6/1982 | Gilman . | |
| 4,336,576 | | 6/1982 | Crabtree . | |
| 4,425,604 | | 1/1984 | Imai et al. . | |
| 4,450,512 | * | 5/1984 | Kristofek | 362/276 |
| 4,499,529 | | 2/1985 | Figueroa . | |
| 4,669,033 | | 5/1987 | Lee . | |
| 4,729,080 | | 3/1988 | Fremont et al. . | |
| 4,754,377 | | 6/1988 | Wenman . | |
| 5,062,030 | | 10/1991 | Figueroa . | |
| 5,192,129 | | 3/1993 | Figueroa . | |
| 5,199,786 | | 4/1993 | Baliozian . | |
| 5,253,151 | | 10/1993 | Mepham et al. . | |
| 5,355,291 | | 10/1994 | Subisak et al. . | |
| 6,079,851 | * | 6/2000 | Altman et al. | 362/260 |

* cited by examiner

*Primary Examiner*—Sandra O'Shea
*Assistant Examiner*—Bertrand Zeade
(74) *Attorney, Agent, or Firm*—Dority & Manning, P.A.

(57) ABSTRACT

A reflector for a light fixture having elongated light elements, wherein the light fixture opens at the ceiling surface and is recessed thereabove, includes a generally cylindrical bottom section defining a circular opening. A substantially enclosed top section defines a generally rectangular, corrugated top surface and a side portion tapering inwardly from the bottom section to the top surface.

18 Claims, 3 Drawing Sheets

RECESSED LIGHT FIXTURE AND REFLECTOR

BACKGROUND OF THE INVENTION

Recessed lighting fixtures typically include a frame attached to a structure such as a joist above the ceiling surface. One or more light elements are disposed in a reflector held by the frame that opens into the ceiling. Although it may include holes in which the light elements are secured and replaced, the reflector is typically an otherwise enclosed structure so that it defines a recess extending upward into a ceiling.

Generally, the reflector body is cylindrically shaped and has a flat top surface opposite the reflector's opening. Because of the flat top surface and placement of the light element near the top of the reflector, light is often trapped in the reflector. Thus, looking straight up into such a fixture, the reflector's top inside surface often appears dark.

SUMMARY OF THE INVENTION

The present invention recognizes and addresses the foregoing disadvantages, and others, of prior art construction and methods.

Accordingly, it is an object of the present invention to provide an improved recessed light fixture.

It is a still further object of the present invention to provide a reflector for a ceiling recessed light fixture having an improved efficiency and light output.

Some of these objects are achieved by a reflector for a light fixture having elongated light elements, wherein the light fixture opens at the ceiling surface and is recessed thereabove and wherein the reflector comprises a generally cylindrical bottom section defining a circular opening and a substantially enclosed top section defining a generally rectangular, corrugated top surface and a side portion tapering inwardly from the bottom section to the top surface.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
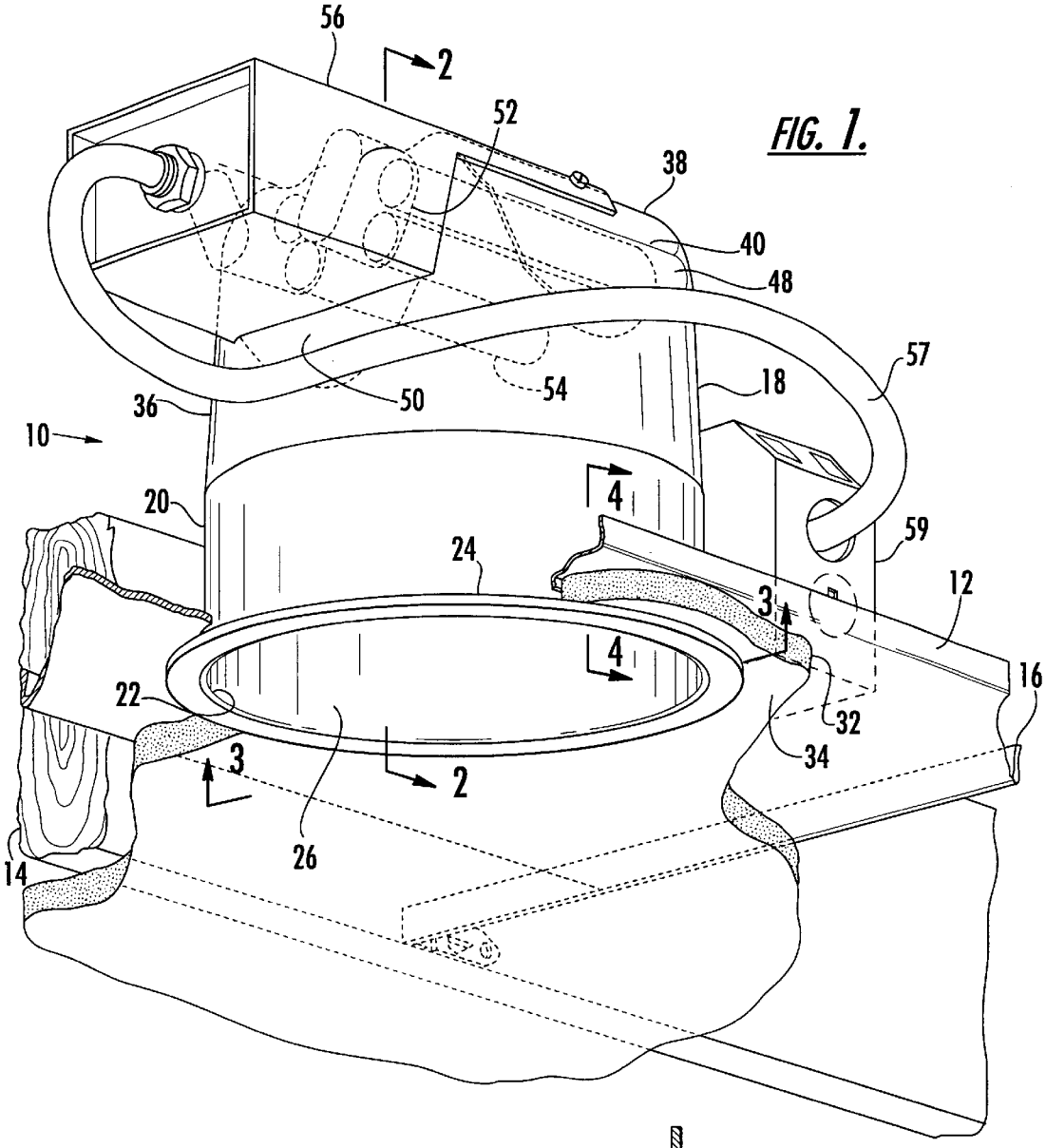
FIG. 1 is a perspective view of a light fixture according to the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it would be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention is directed to recessed light fixtures, which generally define a non-elongated opening in a ceiling surface. Accordingly, although such fixtures often include fluorescent tube lights, these are not the large tubes found in many ceiling mounted fixtures. Rather, such tubes are relatively short, typically between 4 inches and 8 inches in length.

Referring to FIG. 1, a light fixture 10 includes a frame having a generally planar plate 12 attached to opposing ceiling joists 14 (one of which is shown in FIG. 1) by two brackets 16 (one of which is shown in FIG. 1) extending between the joists on either side of a hole in plate 12 in which a reflector 18 is received. Reflector 18 includes a cylindrical bottom section 20 extending through the hole in plate 12 and ending in a circular hole 22 surrounded by an annular flange 24. Preferably, the inner surface 26 of bottom section 20 is continuous. It could, however, include holes to receive pins or other mechanisms to secure the reflector to the frame. Moreover, it should be understood that the frame may be constructed, and may attach to the ceiling, in any suitable manner. For example, the brackets may attach to T-bars rather than joists.

Figure 4:
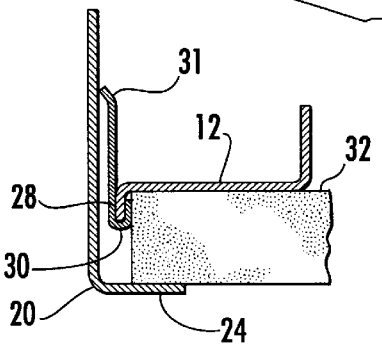
FIG. 4 is a partial cross-sectional view of the light fixture as in FIG. 1.

Referring also to FIG. 4, the extruded hole in plate 12 is surrounded by a vertically extending flange 28. Three clip springs 30 (one of which is shown in FIG. 4) are disposed approximately 120° C. apart around flange 28. Their outer ends 31 bear against bottom section 20 so that the reflector is secured in position.

A horizontal ceiling section 32 defines the ceiling surface 34. A roughly circular hole is cut through ceiling section 32 at the hole in plate 12 so that the reflector bottom section 20 extends therethrough. As shown in FIG. 4, flange 24 covers the rough cut in ceiling section 32, which extends between flange 24 and plate 12.

Figure 2:
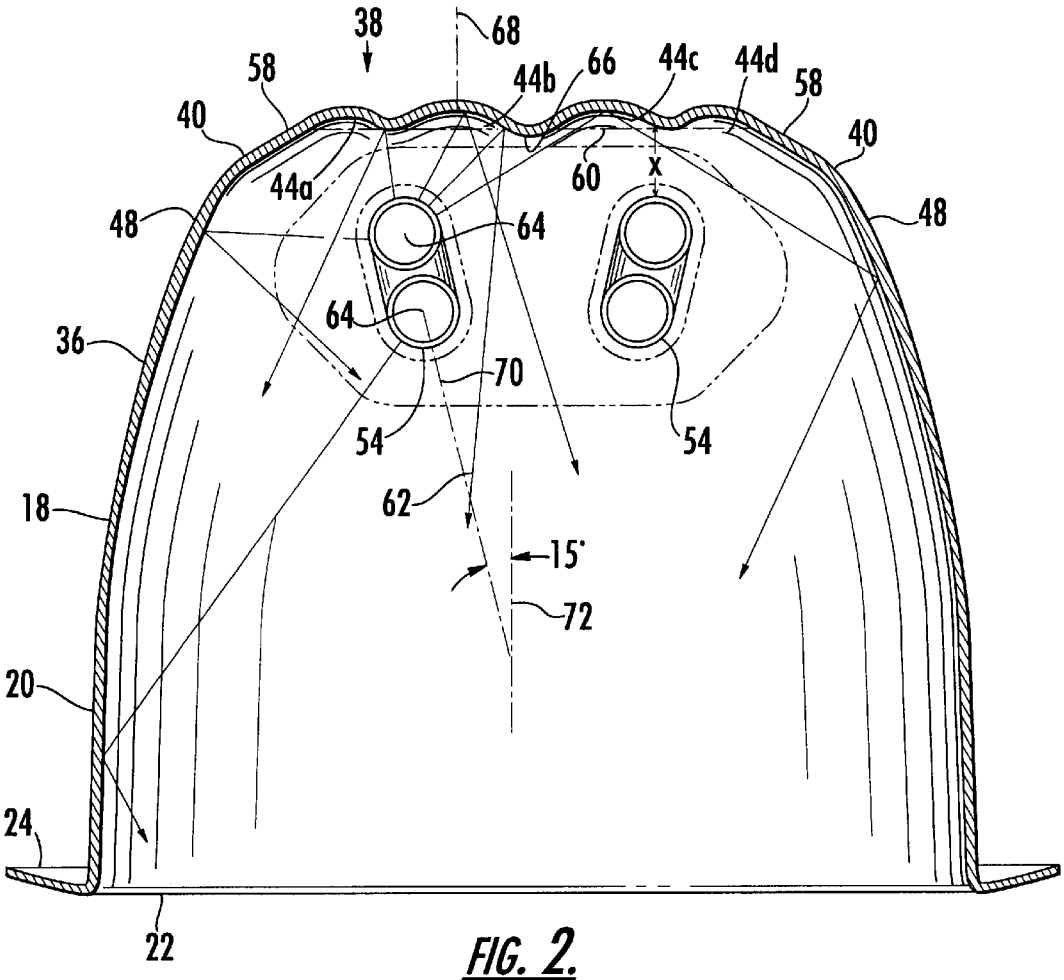
FIG. 2 is a cross-sectional view of the light fixture reflector taken along the line 2—2 as in FIG. 1.
Figure 3:
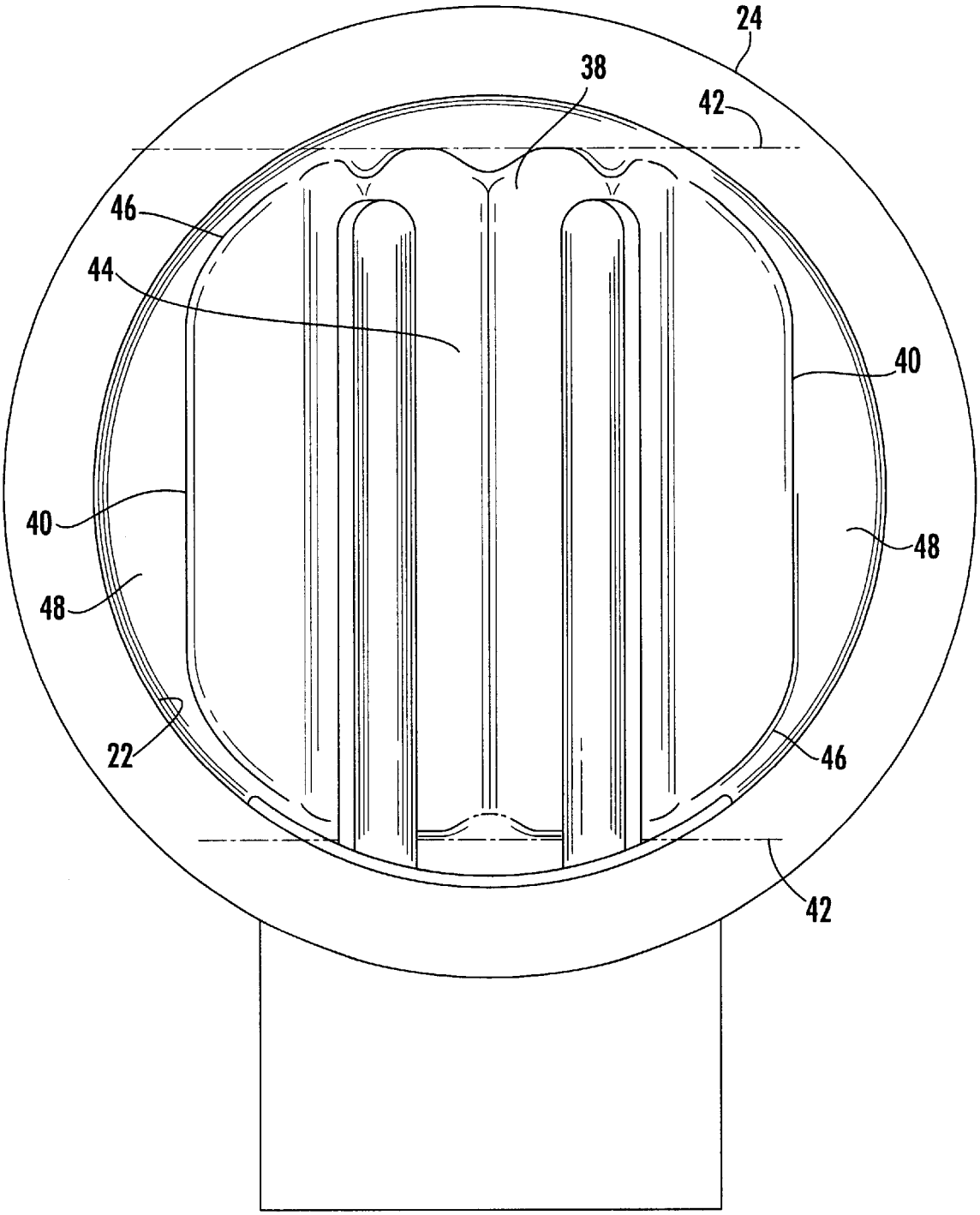
FIG. 3 is a plan view of the light fixture reflector taken along the line 3—3 in FIG. 1.

Reflector 18 includes a top section 36 extending from bottom section 20 and ending in a generally rectangular and corrugated top surface 38. Referring also to FIG. 3, the length and width of top surface 38 are not equal. The longitudinal sides include edges 40, and the transverse sides indicated by dashed lines 42 are defined by the ends of two center corrugation troughs 44. Four arcuate corners 46 connect the transverse and longitudinal sides. As shown in FIG. 3, the dimensions of top surface 38 are such that the top surface fits within a circle defined by opening 22. Thus, top portion 36 tapers inwardly from bottom section 20 to top surface 38, as shown in FIG. 2. Top section 36 defines a respective transition section 48 extending from each edge 40 and a respective transition section 50 extending from each edge 42.

Two holes 52 (one of which is shown in FIG. 1) are formed opposite each other in top section 36 generally in the two transition sections 50. Two U-shaped florescent light tubes 54 are secured in a first hole 52 by a bracket 56. The opposite hole 52 (not shown) allows an operator to reach into the reflector to replace the tubes. A cable 57 extends from bracket 56 to a junction box 59 in which electrical connections are made. The present invention may be used within any suitable electrical configuration. Such configurations should be well understood by those of ordinary skill in this art and are therefore not discussed in detail herein.

Referring now to FIG. 2, top surface 38 includes four parallel troughs 44*a*–44*d*, each defining an arcuate cross section having a radius of curvature of 0.562 inches, 0.875 inches, 0.813 inches and 0.562 inches, respectively. A flat side 58 intercepts each of the outer troughs approximately at its midpoint. The intersection of flats 58 and transition sections 48 form edges 40. In this embodiment, the inner diameter of cylindrical section 20 is approximately 6.3 inches. The width of the rectangular top surface, measured between edges 40, is approximately 4.5 inches, while the length, measured between lines 42 (FIG. 3), is approximately 5.5 inches. The distance X between fluorescent tubes 54 and a plane 60 defined by the parallel ridges between troughs 44 is approximately 0.313 inches. The depth of reflector 18, measured between opening 22 and plane 60, is approximately 5.5 inches.

It should be understood, however, that the particular dimensions and design of reflector 18 may vary significantly according to the needs of a particular system and/or space limitations in the ceiling. For example, the reflector's depth is typically no greater than approximately 5.5 inches when the ceiling is constructed using 2 inch by 6 inch joists. Further, the diameter of opening 22 typically ranges between approximately 4 inches and approximately 8 inches.

In addition, while two fluorescent tubes 54 are illustrated in the drawings, it should be understood that any suitable number, arrangement and positioning of such light elements may be employed within the present invention. This can also effect the design of the corrugated top surface and the reflector's side surfaces since these surfaces are designed to optimize the reflection of light from the tops and sides of elements 54 out of the reflector. As discussed below, the radii of curvature of troughs 44 and the degree to which the interior surfaces of top section 36 taper inwardly to the top surface are chosen so that light, indicated in part at lines 62, is reflected from the troughs and/or the side surfaces out of opening 22.

The sides of back section 36 taper inwardly from cylindrical portion 20 to top surface 38 so that light coming laterally from light elements 54 or that has been reflected from troughs 44 is reflected downward either out of opening 22 or to the inner surface of bottom section 20. Such light directed to the vertical bottom section side is incident downward at an oblique angle and is therefore reflected downward toward opening 22. Further, since light elements 54 are disposed in the reflector above bottom section 20, light incident on the bottom section's inner surface directly from light elements 54 is also incident downward at an oblique angle and is therefore reflected out of opening 22, either directly or after successive reflections.

The radii of curvature of troughs 44 may vary with the placement and size of tubes 54. It is preferable, however, that the inner surface of top surface 38 be configured, and that light elements 54 be positioned, such that light emitted from elements 54 to top surface 38 should be incident on top surface 38 at an oblique angle.

Accordingly, the axis 64 of at least the upper leg of each fluorescent tube 54 is preferably parallel to, but laterally offset from, each ridge 66 between troughs 44 and each center line 68 of each trough 44 so that light from tubes 54 incident on ridges 66 and center lines 68 is incident at an oblique angle. Such light is therefore not directed back to the light element from which it originated. Light from elements 54 otherwise striking the curved trough surfaces are reflected either directly out of hole 22 or to an inner surface of top section 36 or bottom section 20. As noted above, the inwardly tapered side surface of top section 36 reflects such light downward toward hole 22, and the vertical side of bottom section 20 receives such light at a downward oblique angle so that it is also reflected toward the hole.

Figure 5:
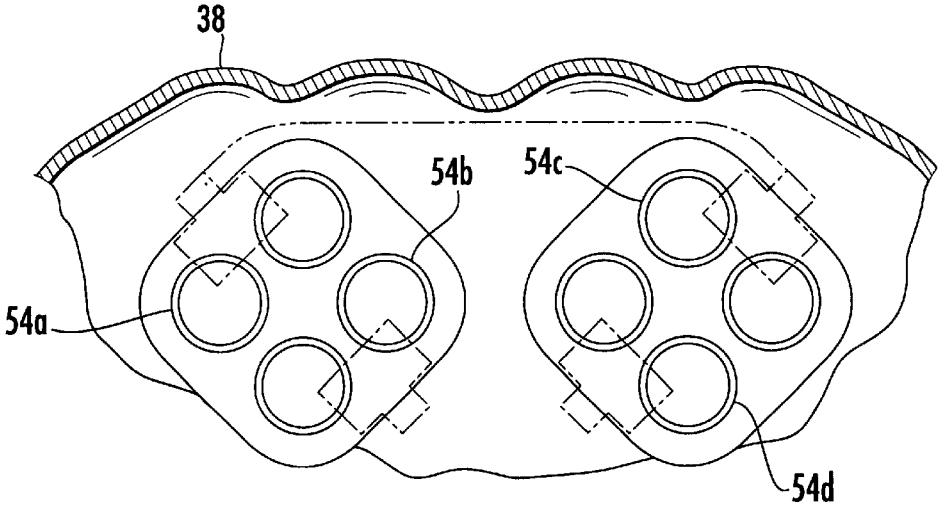
FIG. 5 is a partial cross sectional view of a light fixture reflector in accordance with an embodiment of the present invention.

As noted above, light elements 54 may be configured or oriented in any suitable manner. For example, while the light elements may be oriented in any suitable manner, it has been found that an offset of approximately 15 degrees, measured between a line 70 passing through axes 64 and a vertical line 72, increases the light fixture's efficiency, measured as the amount of light going out of hole 22 divided by the amount of light output by light elements 54. Line 72 is parallel to the axis of bottom section 20. Other suitable variations are also possible. For example, referring to FIG. 5, four light elements 54*a*–54*d* are mounted in the reflector.

Reflector 18 may be formed by a hydraform process in which an aluminum blank is placed over a male die shaped to form the inner surface of the reflector. The die is pushed into the blank from one side to form the interior surface. At the same time, liquid is applied under pressure to the opposite side of the blank to maintain relatively uniform pressure on the reflector's outer surface as it is formed by the male die. Such processes should be familiar to those skilled in the art and are therefore not discussed in more detail herein.

While one preferred material for use in forming reflector 18 is aluminum, it should be understood that any suitable material may be used. Once the material has been shaped, it is polished by any suitable method, as should be well understood in this art. Following polishing, further techniques may be used to increase the reflectivity of the reflector's interior surface. In some cases, for example, it is desirable that light from the reflector be relatively diffused, and coverings may be provided over the opening for this effect. In these and other constructions, the reflector's interior surface may be painted white so that the reflectivity (that is, the percentage of light incident on the surface that is reflected) is approximately 85%. In general, it is preferred that the reflector's interior surface be at least approximately 75% reflective.

In other embodiments, a specular surface is desired, and several suitable methods may be used to produce such a highly reflective surface. For example, those skilled in the art should be familiar with aluminum anodizing processes which coat the aluminum with an oxide layer through the use of an electrolyte such as chromic acid or sulfuric acid. One preferred anodizing finish is an ALZAK finish, available from licensed distributors from Alcoa Corporation. A 3002 grade aluminum should be used where an ALZAK finish is employed, whereas a 1100 series aluminum is typically otherwise suitable.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the literal or equivalent scope of the appended claims.

What is claimed is:

1. A reflector for a light fixture having elongated light elements, said reflector comprising:

a generally cylindrical bottom section defining a circular opening;

a substantially enclosed top section defining a generally rectangular, corrugated top surface configured to reflect light through said circular opening and a side portion tapering inwardly from said bottom section to said top surface; and wherein the light fixture opens at the ceiling surface and is recessed thereabove.

2. The reflector as in claim 1, wherein said top section defines at least one hole in said side portion for receiving at least one said elongated light element.

3. The reflector as in claim 1, wherein said corrugated surface defines parallel troughs each having an arcuate cross section.

4. The reflector as in claim 1, wherein the length and width of said rectangular top surface are unequal.

5. The reflector as in claim 1, wherein said rectangular top section defines opposing substantially straight edges parallel to corrugation troughs in said top section and four arcuate corners extending from said straight edges to opposing sides of said top section transverse to said edges.

6. A light fixture for use in a ceiling structure so that the light fixture opens at the ceiling surface and is recessed thereabove, said fixture comprising:

a frame;

a reflector secured in position by said frame, said reflector including a generally cylindrical bottom section defining a circular opening, and a substantially enclosed top section defining a generally rectangular, corrugated top surface configured to reflect light through said circular opening and a side portion tapering inwardly from said bottom section to said top surface; and at least one elongated light element disposed in said reflector rearward of said bottom section and axially aligned with troughs in said top surface.

7. The fixture as in claim 6, wherein said side portion defines a hole through which said at least one elongated light element is received.

8. The fixture as in claim 7, wherein said at least one elongated light element comprises a fluorescent tube.

9. The fixture as in claim 6, wherein said top surface includes a respective flat surface intersecting each of two outermost said troughs.

10. The fixture as in claim 6, including a respective ridge between each adjacent said troughs, wherein the axis of said at least one light element is laterally offset from each said ridge and is laterally offset from the vertical center line of each said trough.

11. The fixture as in claim 8, wherein said at least one fluorescent tube includes two parallel legs and is disposed so that a first line passing through the axes of said parallel legs and passing through a second line parallel to the axis of said generally cylindrical bottom section forms an acute angle with said second line.

12. The fixture as in claim 11, wherein said acute angle is approximately 150°.

13. The fixture as in claim 6, including two said elongated light elements.

14. The fixture as in claim 13, wherein each said elongated light element includes a fluorescent tube having two parallel legs.

15. The fixture as in claim 14, wherein at least one of said fluorescent tubes is disposed so that a first line passing through the axes of said parallel legs and passing through a second line parallel to the axis of said generally cylindrical bottom section forms an acute angle with said second line.

16. The fixture as in claim 15, wherein said acute angle is approximately 150°.

17. A light fixture for use in a ceiling structure so that the light fixture opens at the ceiling surface and is recessed thereabove, said fixture comprising:

a frame;

a reflector secured in position by said frame, said reflector including a generally cylindrical bottom section defining a circular opening, and a substantially enclosed top section defining a corrugated top surface configured to reflect light through said circular opening and a side portion extending from said bottom section to said top surface; and at least one elongated light element disposed in said reflector rearward of said bottom section.

18. A reflector for a light fixture having elongated light elements, wherein the light fixture opens at the ceiling surface and is recessed thereabove, said reflector comprising:

a generally cylindrical bottom section defining a circular opening; and a substantially enclosed top section defining a generally rectangular, corrugated top surface and a side portion tapering inwardly from said bottom section to said top surface, wherein said bottom section and said top section define interior surfaces that are at least 75% reflective.

* * * * *

UNITED STATES PATENT AND TRADEMARK OFFICE

CERTIFICATE OF CORRECTION

PATENT NO. : 6,254,257 B1
DATED : July 3, 2001
INVENTOR(S) : Philip Sieczkowski

It is certified that error appears in the above-identified patent and that said Letters Patent is hereby corrected as shown below:

Column 6,
Line 11, should read
12. The fixture as in claim 11, wherein said acute angle is approximately 15º.
Line 23, should read
16. The fixture as in claim 15, wherein said acute angle is approximately 15º.

Signed and Sealed this

Second Day of December, 2003

JAMES E. ROGAN
*Director of the United States Patent and Trademark Office*